United States Patent [19]

Miles

[11] 4,359,884

[45] Nov. 23, 1982

[54] DUAL KEY LOCKS HAVING IMPROVED PRECISION AND VERSATILITY

[76] Inventor: James M. Miles, 1511 E. Edinger, Santa Ana, Calif. 92705

[21] Appl. No.: 225,304

[22] Filed: Jan. 15, 1981

Related U.S. Application Data

[63] Continuation-in-part of Ser. No. 45,124, Jun. 4, 1979, Pat. No. 4,332,153.

[51] Int. Cl.[3] ..... E05B 35/12

[52] U.S. Cl. ..... 70/339; 70/355; 70/385

[58] Field of Search ..... 70/337, 339, 355, 382, 70/383, 384, 385

[56] References Cited

U.S. PATENT DOCUMENTS

| | | | |
|---|---|---|---|
| 1,148,282 | 7/1915 | Benham | 70/339 |
| 3,127,759 | 4/1964 | Ellis | 70/339 |
| 4,072,032 | 2/1978 | Phillips | 70/339 |
| 4,332,153 | 6/1982 | Miles | 70/339 |

*Primary Examiner*—Robert L. Wolfe

*Attorney, Agent, or Firm*—Charlton M. Lewis

[57] ABSTRACT

The lock configuration described in the parent application enables a dual key lock to operate efficiently, accurately and conveniently with a single stack of tumblers. Also, the individual tumblers of the invention are typically receivable in the lock in a plurality of alternative orientations in which their gates assume different functions, facilitating key changes. The present application discloses means for further improving the precision of gate positioning in such locks, and remarkably simple and economical means for adapting such locks for either right- or left-hand installation.

26 Claims, 8 Drawing Figures

DUAL KEY LOCKS HAVING IMPROVED PRECISION AND VERSATILITY

RELATED PATENT APPLICATION

This application is a continuation-in-part of the copending application Ser. No. 45,124, filed June 4, 1979 and now U.S. Pat. No. 4,332,153. Any part of that parent application that is not explicitly recited in the present application is nevertheless intended to form a part of the present application, and is incorporated therein by reference.

BACKGROUND OF THE INVENTION

This invention has to do with locks, and relates especially to locks that require two keys for their operation, as is typically true, for example, in locks for safe deposit boxes and similar applications.

Locks of that general type ordinarily require a correspondingly large number of parts, making them relatively expensive to manufacture and service. In particular, if each key drives a distinct and independent set of tumblers the number of moving parts in the lock may approach twice that required in a single-key lock.

Dual key locks have been proposed, as in U.S. Pat. No. 3,127,759 to Roy T. Ellis, for example, having a single stack of floating tumblers which are engaged by the two keys at spaced positions along their length. However, the tumblers of Ellis' single stack are of complex shape and require numerous auxiliary levers and secondary tumblers for their operation. Moreover, the gate positions on each tumbler's primary working edge must take account of the bit height of both the keys. Thus, if the key combination is to be changed by replacing one set of tumblers by a set corresponding to a new pair of keys, a very large number of different tumbler forms must be kept on hand.

The invention described in the above identified parent application provides dual key locks which combine remarkable simplicity of basic form with improved accuracy of operation. The locks of that invention typically require no more parts, aside from the obvious need for two key noses or posts, than the most rudimentary of single key locks having the same number of teeth per key. The structure of the invention permits the keys to position the lock tumblers with such accuracy that it becomes feasible to provide an increased number of bit heights within a given range of radial key dimensions.

Those and other advantages of the invention are typically attained by employing a single stack of elongated tumblers each of which has two gated transverse blocking edges adapted to cooperate with respective fence lugs. The tumblers are laterally positioned by dual keys that engage the tumblers directly opposite the respective blocking edges. That simple configuration has been found to permit each key to act accurately and reliably to bring the corresponding gates into alignment to release the corresponding fence lug essentially independently of the action of the other key.

That independence of function of the two keys further permits the tumblers to be designed with such symmetry that each one can be installed in the lock in two, or preferably in four, alternative orientations, each such orientation corresponding to a different combination of bit heights on the two keys. Since each tumbler can provide four, say, different key combination, the number of different tumbler configurations required to make up any desired number of key combinations is typically reduced by a factor of four. The cost and labor of making key changes are thus significantly reduced.

SUMMARY OF THE PRESENT INVENTION

The present application is directed to certain further structural features which improve the accuracy of operation and the versatility of use of the locks described and claimed in the parent application.

Although the previously described illustrative structures provide substantially independent action of each key in positioning its associated gates to release the corresponding fence lug, a potential interaction has now been discovered between the two keys, such that large differences of level at one key may produce a slight misalignment of the gate associated with the other key. The present invention provides compensation for that potential source of error by suitable alteration of the shape of the tumbler edge at which each key engages and drives the tumbler. It has been discovered that excellent compensation is obtainable by curving each driving edge convexly about a selected center of curvature. That center is typically selected at an intermediate point of the associated blocking edge in which the gates are formed. When all of the driving edges of the tumblers are cured in that general manner, the precision of gate alignment is significantly improved.

A further aspect of the present invention reduces the expense and inconvenience normally involved in providing locks for both right-hand and left-hand installation. In previous practice it has usually been necessary to provide several parts of the lock, including in particular the housing and the bolt, each in two distinct forms, typically mirror-images of each other, for right and left installation. The present invention utilizes the described basic symmetry of form and operation of the present structure, in combination with further novel features of design, for permitting a single set of parts to be assembled alternatively in either right or left configuration. In preferred form of the invention, an assembled lock can be transformed from one configuration to the other by only relatively minor rearrangement of parts. Thus, if a conventional lock needs to be replaced, for example, a single lock in accordance with the present invention will serve as replacement whether right or left installation is found to be required.

BRIEF DESCRIPTION OF THE DRAWING

A full understanding of the invention, and of its further objects and advantages, will be had from the following description of certain illustrative manners of carrying it out. The particulars of that description, and of the accompanying drawings which form a part of it, are intended only as illustration and not as a limitation upon the scope of the invention, which is defined in the appended claims.

In the drawings.

DESCRIPTION OF PREFERRED EMBODIMENT

Basic Structure

Figure 1:
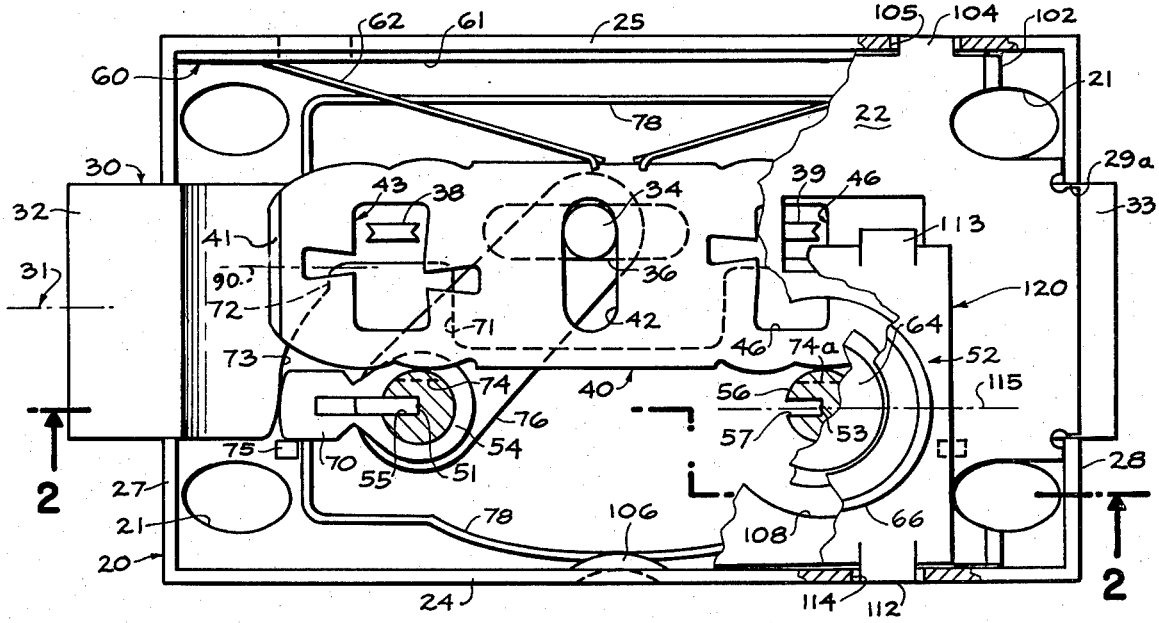
FIG. 1 is an elevation, partially broken away, representing an unmounted lock illustrative of the present invention, arranged for right-hand operation and in the aspect indicated by line 1—1 of FIG. 6.
Figure 2:
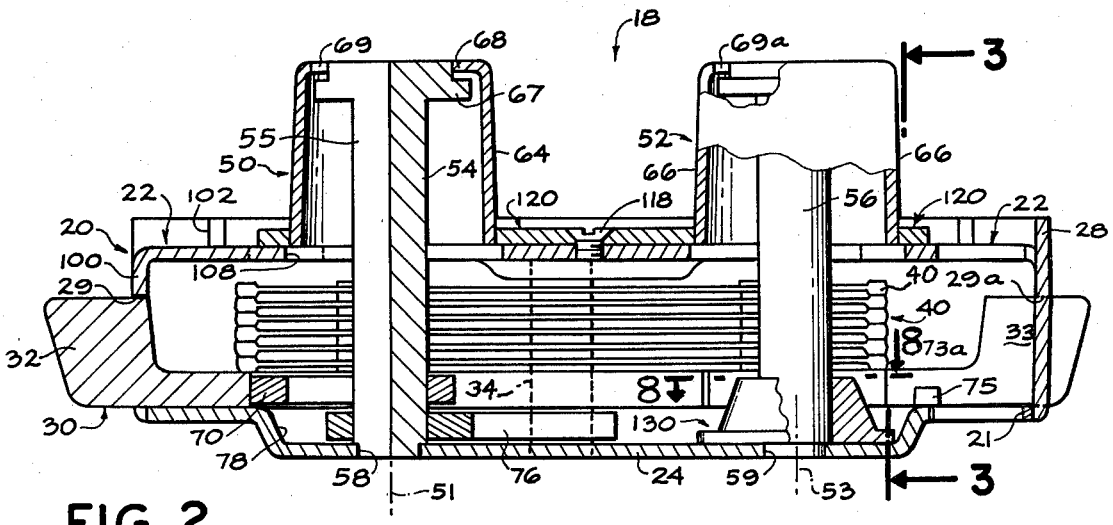
FIG. 2 is a section taken generally on line 2—2 of FIG. 1.

The illustrative lock shown in the drawings comprises the case 20 of conventional rectangular box shape with the removable cover plate 22 mainly broken away. For clarity of description, the lock will be assumed to be in its normal orientation, as shown in FIG. 1, for example, but without implying any limitation to such use. Case 20 includes the rectangular back wall 24, the upper and lower side walls 25 and 26, and the two end walls 27 and 28. The bolt 30 is mounted in case 20 for sliding movement along the bolt axis 31, which is parallel to the length of the case. The bolt has an enlarged working end, or head, 32 at its left end, as seen in FIGS. 1 and 2, which projects with a sliding fit through the rectangular aperture 29 in case end wall 27. The bolt also carries an enlarged head 33 at its opposite end, which is projectible through a corresponding aperture 29*a* in case end wall 28.

The bolt is typically guided in its movement by case back wall 24, by sliding fit of its heads 32 and 33 in the respective end wall apertures, and in some respects by the guide pin 34, which is slidingly received in the longitudinal slot 36 in the bolt. Preferred mounting of pin 34 is described below. The bolt rigidly carries the two upstanding fence lugs 38 and 39, which are typically of like form and are spaced longitudinally of the bolt on opposite sides of guide slot 36.

Figure 3:
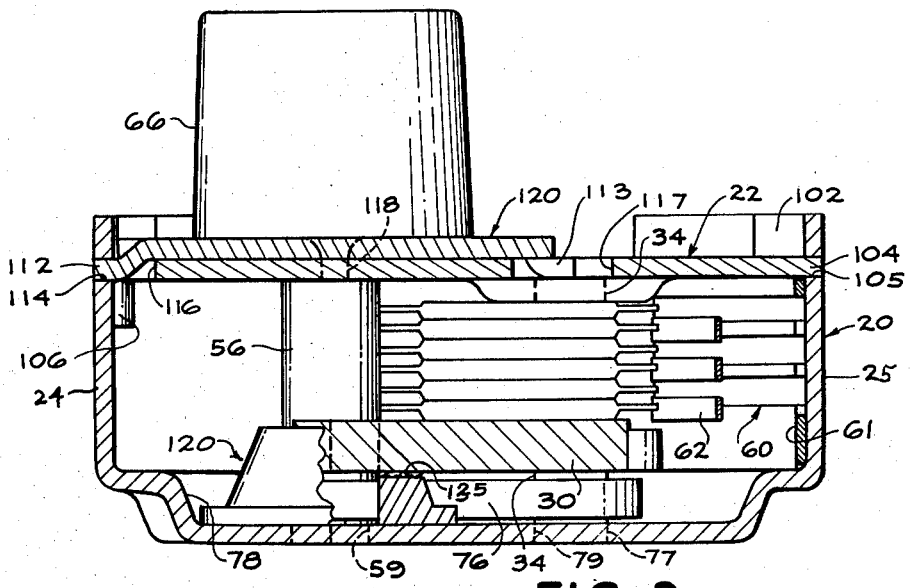
FIG. 3 is a section taken generally on line 3—3 of FIG. 2, at enlarged scale.
Figure 5:
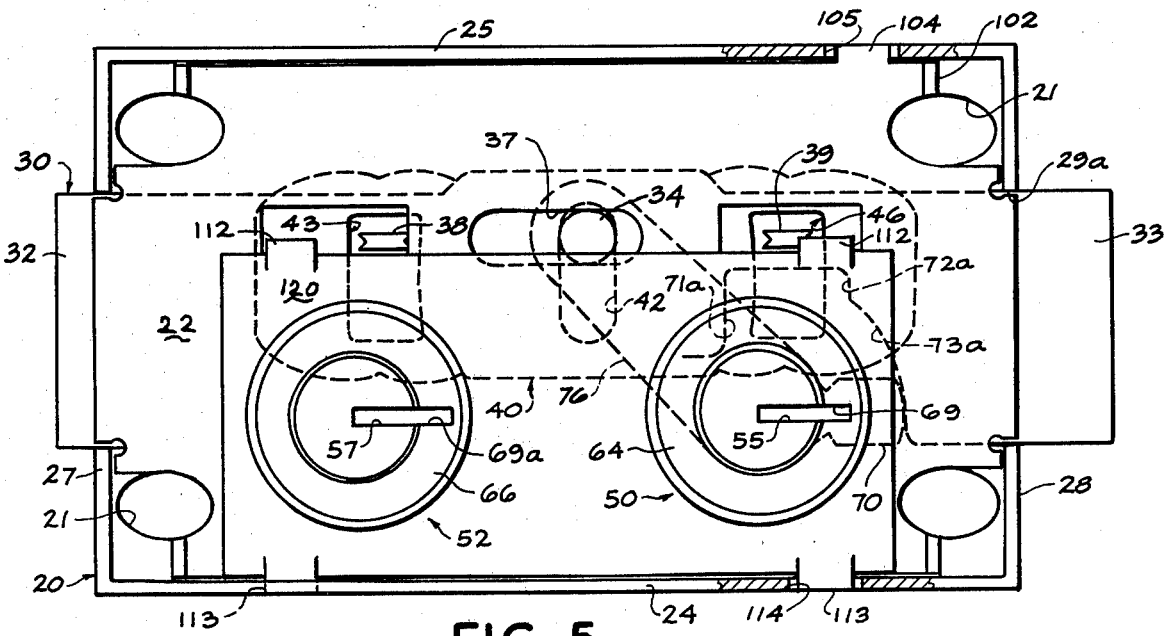
FIG. 5 is an elevation similar to FIG. 1, but representing a lock arranged for left-hand operation.
Figure 6:
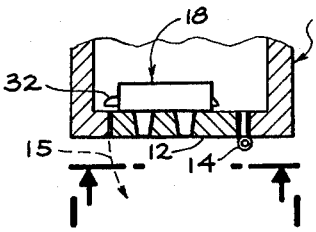
FIG. 6 is a schematic horizontal section representing a dual key lock installed for right-hand operation.
Figure 7:
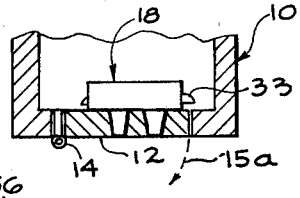
FIG. 7 is a section corresponding to FIG. 6, but representing typical left-hand installation.

The lock is ordinarily installed with the outer face of cover plate 22 toward the inside surface of the door that is to be locked. The screw apertures 21 at the case corners and in cover plate 22 facilitate such mounting. Such typical mounting of the lock is shown in schematic horizontal section in FIGS. 6 and 7. The enclosure 10 is closed by the door 12, which is hinged at 14. Such a door may be hinged at the right, as in FIG. 6, opening at the left as indicated by the arrow 15; or can be hinged at the left and open at the right as indicated by the arrow 15*a* in FIG. 7. FIGS. 1 to 3 represent preferred lock structure assembled illustratively for left-hand installation, with its left-hand bolt head 32 as the working head and with head 33 idle. Lock assembly for right-hand installation (FIG. 7) is represented in FIG. 5, and will be more fully described below. The direction along bolt axis 31 toward the working head of the bolt will be referred to for clarity of description as forward, that toward the idle bolt head as rearward.

The tumblers 40 are slidably mounted in a stack between the flat upper face of bolt 30 and the inner face of cover plate 22. They are guided in their transverse sliding movement by pin 34, which is slidingly received in the transverse guide slot 42 of each tumbler and positively defines the tumbler position longitudinally of bolt axis 31. The tumblers are typically formed of relatively thin sheet metal, made thicker at each end at 41, as by folding back the metal, thus providing relief over the entire remaining area. Each tumbler has typically two transverse control slots 43 and 46, equally spaced on opposite sides of guide slot 42. In locking position of the bolt, shown in FIGS. 1 and 2, tumbler control slots 43 and 46 freely receive the respective bolt fence lugs 38 and 39, normally blocking bolt movement toward releasing position.

The two key noses 50 and 52 are mounted in case 20 adjacent the lower edge of the tumbler stack and mutually spaced longitudinally of the tumblers. The key noses typically comprise the core members 54 and 56, which are journaled on the key axes 51 and 53. The back ends of the cores turn in the respective bores 58 and 59 in back wall 24. Their other ends project from the housing proper within the protective collars 64 and 66, and terminate in the head formations 67 which are journaled by the internal collar flanges 68. The collars extend through clearance bores in the door on which the lock is mounted, making the key noses accessible from outside the door. The cores are slotted at 55 and 57 in conventional manner to receive their respective keys, not explicitly shown, which are rotatable with the nose cores between generally horizontal bolt locking positions and generally vertical bolt releasing positions.

Tumblers 40 are individually biased laterally toward the two key noses by spring means, shown illustratively as the unitary spring 60 which comprises the base portion 61 and the individual spring arms 62. Each arm is provided with a tumbler engaging finger structure adapted to embrace the upper edge of a tumbler approximately midway of its length. The resulting downward force on each tumbler maintains its lower edge in light contact with both key noses when the keys are in bolt locking positions, as in FIG. 1, for example. As the keys are rotated clockwise to bolt releasing positions, indicated schematically at 80 and 82 in FIG. 4, each tumbler is lifted by the key teeth to a definite elevated position, slightly compressing the respective spring arms.

Figure 4:
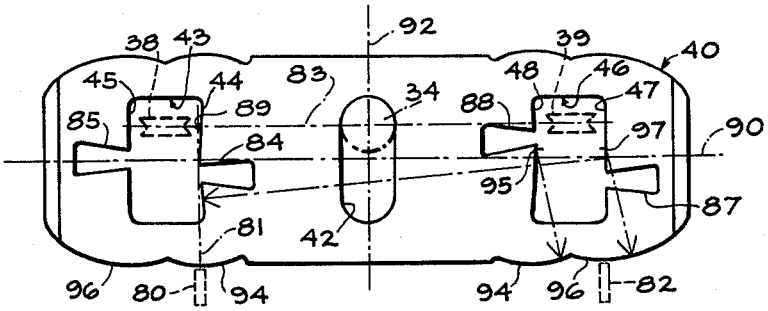
FIG. 4 is a schematic plan representing an illustrative tumbler embodying certain aspects of the invention.

Control slots 43 and 46 of each tumbler are provided on their rearward edges 44 and 47 with gate recesses, shown typically at 84 and 87, respectively (FIG. 4). Those gates are just wide enough to receive the fence lugs comfortably, and are positioned laterally of each tumbler in accordance with the various bit heights of the corresponding key. Clockwise rotation of both keys to their bolt releasing positions, with nose slots 55 and 57 vertical, lifts each of the tumblers a distance just sufficient to align the gates with the respective fence lugs 38 and 39. The bolt is thus released from the blocking action of the tumblers at both control slots.

Figure 8:
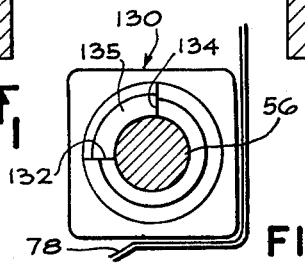
FIG. 8 is a fragmentary section on line 8—8 of FIG. 2 at slightly reduced scale.

In safe deposit practice the customer's key is regularly inserted in a particular one of the key noses, and is operated after the guard key in the other nose has been operated. A lever 70 is mounted on core 54 of that customer's key nose in fixed rotational relation, defined typically by the flat 74 on that core. That lever engages the bolt faces 71 and 72 in response to key rotation, driving the bolt 30 between its locking and releasing positions. As illustratively shown, the bolt releasing face 71 is engaged by drive lever 70 as the key reaches its vertical position, and further key rotation through a small angle drives the bolt to its fully retracted position, typically defined by pin 34 in bolt slot 36. Counterclockwise key rotation from that position causes lever 70 to engage the second bolt drive face 72, driving the bolt forward. The lever slips off face 72 as the bolt reaches its locking position, and then returns freely along the arcuate clearance surface 73 to its illustrated normal locked position, defined by the stop lug 75. In that position lever 70 positively blocks the blot from release movement. Rotation of the key in nose 52 is positively limited to about 90° by the generally square stop member 130, more fully described below in connection with FIG. 8.

The longitudinal positions of the two key noses along bolt axis 31 are such that the respective keys contact the lower tumbler edges at points approximately opposite the respective tumbler control slots 43 and 46. Stating the preferred relation more precisely, each key axis 51 is directly in line with the normal position of the rearward, or active, edge of the associated control slot 43 or 46. The point of contact of each key on the lower tumbler edge when in bolt releasing position is then also approximately aligned with that active slot edge. That relative location of the key noses has the important result that rotation of each key to bolt releasing position aligns the corresponding tumbler gates virtually independently of any action by the other key. Thus, not only is the bolt fully released by operation of both keys, but operation of either key alone completes the releasing action corresponding to that key, and that action is not disturbed by later operation of the other key.

The attainment of independent key operation with a single set of floating tumblers permits each tumbler to be symmetrical in overall shape. The tumblers can then assume multiple orientations in the lock, providing a correspondingly increased number of key combinations. When tumbler 40 is used in the orientation shown in FIG. 4, for example, the blocking edge 44 and its gate 84 cooperate with key nose 50, while blocking edge 47 and its gate 87 are operative for nose 52. Inversion of the tumbler about horizontal axis 90 does not change that relation, but shifts each gate to the opposite side of axis 90, which ordinarily changes their effective levels. Inversion of the tumbler about vertical axis 92, on the other hand, shifts blocking edge 48 and its gate 88 into position to cooperate with key nose 50, while blocking edge 45 and its gate 85 become effective for nose 52. Successive inversions of the tumbler from the position of FIG. 4 about axes 90 and 92 in either order produce a fourth orientation, typically producing a fourth combination of effective gate levels. It is noted, however, that gate 85 is shown in the special position directly on axis 90, which position is invariant to inversion of the tumbler about that axis. Such a symmetrical position is sometimes useful, as when only the customer's key is to be changed.

Further aspects of tumbler inversion, including in particular its detailed implementation and its breadth of utility, are described in the above identified parent application and are incorporated herein by reference.

Gating Accuracy

As already indicated, althrough the above described positioning of the gate noses makes operation of the two keys virtually independent of each other, it has now been found that the inclination of the tumbler that results when the bit height is greater for one key than for the other tends to cause a slight deviation of the gate from its proper height. That second order effect remains negligible if the maximum angle of tumbler inclination is kept sufficiently small, as can be done in principle by limiting the key combinations to those for which the difference of bit heights is not too great, or, if greater height differences are required, by increasing the separation between the two key noses and correspondingly lengthening the tumblers. Neither of those solutions is fully satisfactory for obvious reasons.

The present invention provides means for virtually eliminating the described source of potential inaccuracy of gating. That is accomplished by suitably shaping the tumbler edge that is contacted by the key as the tumbler is brought to bolt releasing position. More particularly, that driving edge of the tumbler is convexly curved about a point that is adjacent the mouth of the gate itself. Since it would be impractible to form the driving edge with a different curvature for each possible position of the gate along the blocking edge, it is generally preferred to select a common center of curvature closely adjacent the blocking edge and at a position along that edge close to the average of the possible gate positions.

That aspect of the invention may be understood more fully by visualizing the tumbler movement due to operation of one key, for example a key at 82 in FIG. 4, while the other key 80 remains stationary. Such tumbler movement is constrained by support of the tumbler on the stationary key and by guiding action of pin 34 in tumbler guide slot 42. The resulting movement can be described as tumbler rotation about a center of rotation which shifts slightly as the movement progresses. In view of the described constraints, the locus of the center of rotation is at the intersection of a line perpendicular to slot 42 at pin 34, and a line perpendicular to the tumbler driving edge 94 at stationary key 80. As typically shown, that locus is at intersection 89 of line 83 and line 81. With key nose 50 aligned with blocking edge 44, as has been described, that center of rotation tends to remain close to the blocking edge, causing very slight vertical displacement of gate 84. For that reason the error under discussion is always small. However, if operation of key 82 causes significant inclination of the tumbler, driving edge 94 slides over stationary key 80, causing center of rotation 89 to shift away from blocking edge 44. Further tumbler rotation can then produce a second order shift in the level of gate 84.

Such potential gate displacement is virtually eliminated by curving each tumbler driving edge about a selected point in the vicinity of the associated gate mouth, and preferably also in the vicinity of line 83 through pin 34. Since the tumbler gates are necessarily at levels that vary for different keys, and since line 83 shifts laterally of the tumbler as the keys are operated, any center of curvature selected for the driving edge necessarily represents a compromise. A preferred common level for the centers is represented in FIG. 4 by the centers at 95 and 97 for the respective driving edges 94 and 96 associated with control slot 46. Those centers are close to the longitudinal tumbler axis of symmetry 90, which corresponds approximately to the average gate level, but are slightly offset from that axis in the direction of the position assumed by line 83 when both keys are in bolt locking position. The centers of curvature for the other three sets of driving edges are symmetrically placed on the tumbler, but are not explicitly shown in FIG. 4. It is emphasized, however, that since the error to be compensated is itself small, the highest accuracy in designing and forming the curved driving edges is not usually needed. Satisfactory improvement in precision of gating is ordinarily obtainable if the center of curvature for each tumbler driving edge is adjacent the associated blocking edge and within the range of variation of the associated gate mouth.

Versatility for Right and Left Installations

As already indicated, FIGS. 1 to 3 represent an illustrative lock assembled for right-hand installation (FIG. 6) and which can be adapted for left-hand installation (FIG. 7) by carrying out relatively simple changes in arrangement of the parts. Such a lock may be characterized as ambidextrous. In preferred form of the invention, those changes perform a number of distinct functions. However, it may be useful under certain conditions to shift the hand of a lock with performance of only a few of those functions, or, indeed, only one of them.

Bolt Drive

In shifting from right to left operation in accordance with the invention, bolt driving lever 70 is shifted in any suitable manner from the nose core at the left (FIG. 1) to the nose core at the right (FIG. 5). The lever then engages drive surfaces 71*a*, 72*a* and 73*a* of the bolt that are essentially mirror images of surfaces 71 to 73 described above. One method for accomplishing that change is to remove cover plate 22, lift each of the nose cores from its journal bore in the housing back wall, and shift the drive lever from one core to the other before reassembling them in their original positions. For that manner of operation, both nose cores are provided with means for rotational coupling to the lever in the desired angular relation, as typically indicated by the flats 74 and 74*a* in FIG. 1.

Alternatively, a bolt lever might be permanently mounted on each of the nose cores, with spline mechanism operable to selectively couple the appropriate core to its lever upon shifting of the hand of the lock.

A preferred method for shifting the bolt drive to the desired nose core is to interchange the positions of the two nose cores, leaving the lever coupled to core 54 as it is moved. For that method the lever can be permanently mounted on core 54 if desired. Changing the hand of the lock then requires its disassembly only sufficiently to interchange the two nose cores.

Such procedure for shifting between left and right installation is capable of giving useful results whenever only moderate accuracy of gate level is required. For such operation the bolt is typically so dimensioned that both bolt heads are in projected position when the two fences 38 and 39 are centered in their tumbler control slots, and pin 34 is typically fixedly mounted midway of the length of the housing. For right-hand operation the lock is released by bolt movement to the right from that common locking position, under control of the gated blocking edges at the right of each tumbler slot. For left-hand operation the lock is released by moving the bolt to the left from that same locking position, under control of the gates in the blocking edges at the left of the control slots.

For such operation the two key noses cannot be positioned in line with the active blocking edges of the tumblers, as previously described and as shown in the drawings, but are preferably positioned symmetrically with respect to the respective tumbler control slots 43 and 46, that is, in line with the center lines of those slots. That symmetrical position of the key noses means that the gates associated with each key are not positioned entirely independently of the other key. However, especially if the length of each fence lug, and the width of the tumbler control slots, are made as small as possible, the resulting errors of gate level can be kept moderate. For certain applications, as when only a moderate number of key combinations is required, such errors can be accommodated by reducing the number of bit levels and increasing the width of each gate mouth. Thus, if additional functions are not required, that very simple provision for changing the hand of a lock may be satisfactory.

Shift of Key Orientation

It is usually desirable to design locks for safe deposit boxes and similar purposes so that the keys can be inserted or removed from the lock only when the bolt is in locking position. That is commonly accomplished by forming each of the nose collars 64 and 66 with an internal flange 68 so dimensioned as to overlap the key. The flange is radially slotted, as indicated at 69, in the angular position in which the key is to be inserted and removed; and each key is provided with a slot in position to receive the collar flange and permit the key to turn freely when fully inserted. When such action is required in an ambidextrous lock, some provision must be made for reversing the angular position of slots 69 when the hand of the lock is reversed.

An illustrative and preferred manner of providing that function is to mount the collars on a support member that can be assembled in the lock in either one of two positions, such that in one position of the support member the flange slots 69 are oriented as shown in FIG. 1, say, and in the other the two nose collars are interchanged in position and each is rotated 180° with respect to its key axis, as in FIG. 5.

Such a support member is shown as the generally rectangular support plate 120, which is mounted flatly against the outer face of cover plate 22. The two nose collars are fixedly mounted in circular apertures in support plate 120, and ample clearance apertures 108 are provided in cover plate 22 to accommodate the nose cores and keys. The support plate is basically symmetrical with respect to the plane 115 of the two key noses. In each of its alternative positions one of the side edges of the support plate fits inside lower side wall 26 of the housing. Cover plate 22 and support plate 120 are retained in the housing by cooperative action which permits them both to be secured or released by operation of the single screw 118 which secures them together.

Means are provided on the support plate and on the lower side wall of the case whereby either side edge of the plate may be releasably engaged with that case wall in response to relative plate movement substantially in its own plane. As illustratively shown, such means comprise the two slots 114 in the lower side wall of the case and the corresponding ears 112 on one plate side edge and the ears 113 symmetrically placed on the opposite plate side edge. Ears 112 are received in slots 114 when the lock is assembled for right installation (FIGS. 1 to 3) with key slots 69 and 69*a* directed to the left. When assembled for left installation support plate is rotated 180°, presenting ears 113 to slots 114 and directing the key slots to the right (FIG. 5).

The ears 112 and 113, and also slots 114 in the case side wall, are preferably offset back of the plane of the support plate, typically into the plane of cover plate 22. Clearance apertures are provided in the cover plate at 116 for the active retaining ears, and also at 117 for the idle ears. Apertures 117 are preferably made relatively large, providing visibility of fences 38 and 39 and their relation to the tumbler gates.

Cover plate 22 and upper case side wall 25 are provided similarly with means releasably engageable to positively position the upper plate edge relative to the side wall in response to plate movement substantially in its own plane. Such means typically comprise the plate ears 104 which fit the suitably placed side wall slots 105. The lower edge of the cover plate is preferably also supported at the desired level relative to the housing, as on the shelf 106 within the lower case side wall.

With that coordinated construction of the cover plate and support plate, the two plates when assembled by screw 118 in the housing form an effectively unitary cover structure which is accurately and positively retained in position by the two ears 104 and the active pair of ears 112 or 113. For disassembly, screw 118 is removed and support plate 120 is tilted slightly about its pair of active ears, freeing collar flanges 68 from nose core heads 67. The active ears will then slip from their slots 114, and the support plate can be lifted out. Cover plate 22 is thereby made free for similar removal, that is, by tilting it slightly about ears 104 its lower edge is freed of the housing, releasing the ears from slots 105. Reassembly of the two plates reverses that process.

Thus the described construction facilitates changing the hand of the lock by simplifying access to the two nose cores for interchanging their positions. During reassembly, support plate 120 is simply rotated 180° during reinsertion in the case, providing the desired shift of key orientation to correspond to the changed hand of the lock.

Longitudinal Shift of Tumblers

In preferred form of the invention, the process of changing hand of the lock is further improved by maintaining ideal alignment between the key noses and the tumbler blocking edges during both modes of operation. That is accomplished by shifting the tumblers longitudinally of the bolt axis as the hand of the lock is changed. As illustratively shown, guide pin 34, or the equivalent means for defining the longitudinal tumbler position, is mounted on a shiftable support with means for driving its movement as the hand of the lock is changed, and for defining proper operating positions for both the respective left and right operating modes of the lock. Many types of apparatus are well known for performing such a function, and are considered within the proper scope of the present invention.

The presently preferred mechanism, shown illustratively in the drawings, comprises means for positioning the tumblers in the housing with reference to one of the nose cores in such a way that the reference can be shifted between the two nose positions, and that such change of reference automatically shifts the tumblers the desired distance.

In the present structure the desired position for pin 34 is offset from the midplane between the two key noses in the direction toward the active bolt head, and the magnitude of that offset is typically half the width of each of the tumbler control slots 43 and 46. Such positioning of the tumblers can be accomplished in principle by locating the pin with reference to either the nose nearer the active bolt head or the nose nearer the idle bolt head. In view of the direction of the desired offset, the distance to be established is less if it is defined relative to the forward nose, that is, the nose nearer the active bolt head. That selection has the further practical advantage that the pin positioning function and the bolt driving function are both related to the same physical nose core, somewhat simplifying the shifting operation.

The illustrated coupling mechanism for locating and shifting pin 34 comprises the link 76, which is mounted on nose core 54 in freely rotatable relation just back of bolt driving lever 70. Link 76 is typically accommodated in the large shallow well 78 formed in back wall 24 of the housing. The free end of the link is provided with a bore in which pin 34, already described, is mounted rigidly and typically fixedly. The pin is thereby maintained accurately parallel to nose core 54 and at a constant distance from it. The back end of the pin preferably projects slightly from the link at 77 and is slidingly received in the guide slot 79 in wall 24 parallel to bolt axis 31. The angular position of pin 34 about core 54 is defined by its sliding fit in slot 79.

With pin 34 directly coupled to nose core 54, say, the simple interchange of nose cores already described as a method for reversing the bolt drive when changing the hand of the lock serves also to shift the pin position and hence the longitudinal position of the tumblers in the housing. As nose core 54 and link 76 are swung about the pin, the latter is restrained by guide slots 37 and 79, retaining the stack of tumblers against the force of spring 60. The swinging movement of the link is accommodated by well 78. Insertion of nose core 54 in the right-hand journal bore 59 automatically anchors pin 34 in the proper position (FIG. 5) for left-hand operation of the lock with full precision of gating action.

Additional Features and Modifications

A further feature of the invention provides control stops for limiting the motion of the key, typically the guard key, in the key nose that does not carry lever 70 and link 76, while avoiding interference with those elements when the two nose cores are interchanged to alter the hand of the lock. That stop function is performed by a special stop member 130 which is mounted on the guard key nose core and is shifted with that nose core when the hand of the lock is changed. Stop member 130 is typically freely rotatable relative to the core on which it is mounted, and is appropriately positioned in rotation by engagement with abutment means mounted on the case at each core site.

As illustratively shown, stop member 130 comprises a generally annular body with an axial bore for freely receiving the nose core and a generally square plate-like base which rests flatly against the bottom of housing well 78. One quadrant of the annular body is partially cut away to form the two generally radial faces 132 and 134, which oppose each other about 90° apart, and the flat surface 135, which extends between the radial faces perpendicular to the key axis. Surface 135 positively limits the depth of key insertion in the nose, while faces 132 and 134 positively limit rotation of the key and nose core to the desired angular range. At each nose core position, the base plate corner opposite to the cut-away quadrant fits the adjacent square corner of well 79, defining the angular position of the stop member. The latter is shown typically as a die casting, but may be designed alternatively as a sheet metal stamping, for example. Stop member 130 is omitted in FIG. 1 for clarity of illustration.

In a lock having the present capability for convenient change of hand, it is sometimes preferred to utilize only two of the four alternative orientations of each tumbler that are available in principle for facilitating key changes. It may be convenient to change the hand of a lock without altering the keys that will operate it. That can be accomplished by forming each tumbler with identical bit levels for the two gates that cooperate with the customer's key in right and in left operation, and also for the two gates that cooperate with the guard key in right and in left operation. More particularly, as shown in FIG. 4, gates 84 and 88 would be at a common level, and gates 85 and 87 would be at a common level, but typically selected independently of gates 84 and 88. With that restriction imposed, interchange of the key noses to alter the hand of the lock does not affect the corresponding key combination; but reversal of each tumbler about cross axis 92 also does not affect the key combination either, and therefore is not available to aid key changes. However, tumbler reversal about longitudinal axis 90 is still available for changing the key combination, reducing by a theoretical factor of two the number of different tumblers that must be at hand to provide a specified number of key changes.

The above described mechanisms for changing the hand of a lock are readily adaptable to the modified lock forms described in the above identified parent application in connection with FIGS. 10 and 11 of that application. FIG. 10 shows separate sets of tumblers for each key, guided for lateral movement consisting of pure translation without any rotation. The tumblers of each set typically have a single control slot with both opposing slot edges gated. Under that condition the above description of ambidextrous bolt drive and of shifting the key orientation with change of hand are directly applicable. No shift is required in the longitudinal position of the tumblers, since the key noses can be located arbitrarily in absence of any tilting of the tumblers.

FIG. 11 of the parent application also shows separate sets of tumblers for each key, but with the tumblers of each set mounted for pure rotation about fixed pivot axes, which are typically closely adjacent, or may be coincident. To obtain full symmetry of key action for either right or left mode of operation, the key noses are preferably positioned at radii from the tumbler pivots which bisect the tumbler control slots. Ambidextrous bolt drive and key orientation are then obtainable as already described; and, again, no shift of tumbler position is needed when the hand is changed.

FIG. 12 of the parent application shows a single set of tumblers controlled by two keys, with gates formed on oppositely facing blocking edges of two bridge formations for the respective keys, rather than of slot formations. The present discussion and apparatus for changing hand apply with minor and obvious changes of terminology to that clearly equivalent structure. Improved accuracy in gate positioning is also obtainable by curvature of the driving edges of the tumblers in closely similar manner to that described above.

It will be understood that many further modifications may be made in the particular illustrative configurations described herein without departing from the proper scope of the invention. For example, many of the desirable properties are available in single key locks, which may be made interchangeable with dual key locks. If a guard key is not required, for example, the support plate 120 of the present illustrative lock of FIGS. 1 to 3 may be modified by omitting guard key nose collar 66 and replacing nose core 56 by a short stub core for holding the tumblers at a fixed level. Dual fences on the bolt and dual control slots on the tumblers are typically retained, but the outer blocking edge of each control slot is eliminated, as by widening the slot on that side. Only the inner gated blocking edge of the forward control slot is then active.

To change the hand of such a single key lock, the customer's key nose core is interchanged with the described stub core, typically carrying with it the bolt driving lever and the link to guide pin 34, substantially as described for shifting the hand of a dual key lock; and the support plate carrying nose collar 64 is turned through 180°. Thus, the invention can provide single key locks with convenient ambidextrous capabilities. Especially when provided with convexly curved tumbler drive edges, such single key locks typically provide the full precision of gating action that is characteristic of the dual key locks that have been described.

Improved action at the gated blocking edges is obtainable by slightly curving one or more of the blocking edges of each control slot symmetrically with respect to the longitudinal axis of the tumbler. As illustratively shown in FIG. 4, the two inner blocking edges 44 and 48, respectively, of control slots 45 and 46 are convexly curved about centers on axis 90 and at the outer blocking edge of the opposite control slot. Such curvature improves the efficiency with which the fences fit within the control slots permitting the slots to be made narrower for a given length of fence, for example.

The method described above for relieving the tumblers over virtually their entire faces by folding a narrow strip 41 at each end edge has the distinct advantage of saving metal and also compensates slight variations in thickness of the sheet material. During the folding operation the doubled thickness is preferably compressed to an accurately controlled dimension, which may be made substantially independent of usual thickness variations of the sheet stock. The thickened area is preferably offset so that the relief is divided between the two tumbler faces. The width of the region of increased thickness is made sufficient to insure their overlap between each pair of adjacent tumblers in all positions they may assume during operation of the lock. The nature of the tumbler movement produced by this invention permits such overlap to be obtained with quite narrow folded areas, as typically shown in FIG. 2, for example. In locks having other types of tumbler action relief is often obtainable in a similar manner, though the width of the folded strip may then need to be considerably increased.

Many additional modifications may be made in the particular embodiments that have been explicitly described without departing from the true spirit and proper scope of the invention.

I claim:

1. A lock which includes a housing having two end walls, bolt means, means for moving the bolt means along a bolt axis between locking and releasing positions, fence means coupled to the bolt means, at least one set of flat tumblers mounted in the housing for independent movement transversely of the bolt axis, at least one gated blocking edge on each tumbler for cooperation with the fence means to normally block the bolt means from movement toward releasing position, and key receiving means for controlling said tumbler movement to align the gates and unblock the bolt means; said lock being further characterized in that:

each tumbler includes a second gated blocking edge facing oppositely to the first said edge, said bolt moving means include means operable alternatively for moving the bolt means in one direction for bolt projection at one housing end wall for right-hand installation, and for moving the bolt means in the other direction for bolt projection at the other end wall for left-hand installation, said fence means cooperating with one set of blocking edges for controlling bolt operation in one direction and cooperating with the other set of blocking edges for controlling bolt operation in the other direction.

2. A lock according to claim 1 further characterized in that said key receiving means include:

means for receiving and releasing keys only in a predetermined orientation, and means for shifting said predetermined orientation through approximately 180 degrees.

3. A lock according to claim 1, wherein said key receiving means comprise:

two journal means spaced longitudinally of the bolt axis on respective key axes, at least one key nose core mountable selectively in either one of the journal means, and at least one key nose collar mountable on the housing on either one of said key axes in respective orientations differing by approximately 180 degrees, and wherein said bolt moving means comprise:

lever means mountable selectively at either one of said key axes for rotation with the nose core for driving the bolt means in respective opposite directions.

4. A lock according to claim 1 further characterized in that:

said key receiving means includes two key nose cores mountable selectively on either one of two key axes, said fence means includes two fence lugs, and each of said tumblers includes two further oppositely facing blocking edges in such positions that bolt operation in each direction is controlled by a pair of like-facing blocking edges cooperating with the respective fence lugs under control of keys in the respective key nose cores.

5. A lock according to claim 4 further characterized in that said key receiving means include:

means for receiving and releasing keys only in a predetermined orientation, and means for shifting said predetermined orientation through approximately 180 degrees.

6. A lock according to claim 1, wherein said key receiving means comprise two journal means spaced longitudinally of the bolt axis on respective key axes, two key nose cores, each mountable selectively in either one of the journal means, two key nose collars mounted on a support member, and means for mounting the support member on the housing selectively in two alternative orientations differing by approximately 180 degrees with one collar cooperating with each nose core, and wherein said bolt moving means comprise:

lever means mountable selectively for rotation with a nose core at either of said journal means and engageable with the bolt means to move the same.

7. A lock according to claim 6 wherein said key axes are spaced laterally on one side of the tumblers, said housing includes two side walls and a removable cover plate, said support member comprises a support plate carrying the nose collars and with side edges substantially symmetrical with respect to the plane of the two nose collars, and said support member mounting means comprise means for coupling one side edge of the cover plate to the housing side wall on the other side of the tumblers, means for selectively coupling either side edge of the support plate to the other housing side wall, and means for mutually coupling the cover plate and support plate.

8. A lock according to claim 1 further characterized in that said tumbler mounting means includes:

means for shifting the tumblers longitudinally of the bolt axis between a first tumbler position in which one of said blocking edges is aligned with the key receiving means and a second tumbler position in which the other blocking edge is aligned with the key receiving means.

9. A lock according to claim 4 further characterized in that said tumbler mounting means includes:

means for shifting the tumblers longitudinally of the bolt axis between a first tumbler position in which the blocking edges of one said pair are aligned with the respective key axes for bolt operation in one direction, and a second tumbler position in which the blocking edges of the other said pair are aligned with the respective key axes for bolt operation in the other direction.

10. A lock according to claim 9 wherein said tumbler shifting means comprise means for defining the longitudinal positions of the tumblers with respect to one of the key axes to establish a first tumbler position, and for defining the longitudinal positions of the tumblers with respect to the other key axis to establish a second tumbler position.

11. A dual key lock comprising an elongated housing with apertures in its opposite end walls on a housing axis, an elongated bolt carrying two longitudinally spaced fences and having a head at each end adapted for projection through the respective end wall apertures, a stack of flat elongated tumblers mounted in the housing in defined longitudinal position and generally parallel to the axis for lateral movement under key control, each tumbler having two pairs of oppositely facing transverse gated blocking edges adapted for cooperating with the respective fences, two key nose cores normally journaled in the housing on respective key axes which correspond to the respective pairs of gated blocking edges, and bolt driving means for driving the bolt alternatively between projected and retracted relation to a selected one of the housing end walls in response to rotation of a key in a nose core on a corresponding key axis.

12. A lock according to claim 11 further including means for longitudinally shifting the tumblers to align with each key axis the blocking edge of the corresponding pair that faces away from the selected housing end wall.

13. A lock according to claim 11 wherein said bolt driving means comprise a lever adapted to be mounted on a nose core journaled on either one of said key axes for engaging the bolt to drive the same with respect to the corresponding housing end wall.

14. A lock according to claim 12 wherein said tumbler shifting means comprise a guide pin working in a transverse guide slot formed in each tumbler, means for confining pin movement to a path parallel to the housing axis, and link means for coupling the pin to the nose core on one of said key axes upon selection of one housing end wall, and on the other key axis upon selection of the other housing end wall.

15. A dual-key lock comprising bolt means movable along a bolt axis between a locking position and a releasing position and including first and second fence means mutually spaced longitudinally of the bolt axis and coupled to the bolt, a plurality of flat elongated tumblers mounted generally parallel to the bolt axis in defined longitudinal position for lateral movement under key control, each tumbler including two transverse gated blocking edges in positions to cooperate with the respective fence means no normally block the bolt means from said releasing position, first and second key noses laterally offset from the tumblers and approximately aligned with the respective blocking edges, each tumbler having two laterally facing driving edges associated with the respective blocking edges and engageable by keys in the respective key noses to laterally position the tumblers to unblock the bolt means, at least one of said driving edges being curved convexly about a point adjacent the associated blocking edge.

16. A lock according to claim 15 wherein:

each of said driving edges is curved approximately circularly about a point adjacent the average position of the gate mouth of the associated blocking edge.

17. A lock according to claim 15 wherein:

at least one of the blocking edges of each tumbler is curved about a point adjacent the other blocking edge.

18. A set of flat, elongated tumblers adapted to be mounted in a lock, each tumbler having a longitudinal axis and including:

a guide slot transverse of the axis for slidingly receiving a fixed guide member, and structure forming two transverse, like-facing blocking edges spaced on opposite sides of the guide slot and having respective gate recesses for cooperating with fence means coupled to a lock bolt, each tumbler having two laterally facing driving edges engageable by keys in respective key noses to laterally position the tumblers to unblock the bolt means at the respective blocking edges, at least one of said driving edges being curved convexly about a point adjacent the associated blocking edge.

19. A tumbler according to claim 18 wherein said curved driving edge is curved about a point close to the intersection of the associated blocking edge and the tumbler axis.

20. A tumbler set according to claim 18 wherein each tumbler includes two driving edges on each side of the tumbler axis, the positions and shape of each blocking edge and of the two driving edges associated with that blocking edge being symmetrical with respect to the tumbler axis.

21. A tumbler set according to claim 18 wherein each blocking edge on a tumbler is curved about a point adjacent the other like-facing blocking edge.

22. Cover structure for a lock case that includes an effectively unitary base and two side walls, comprising:

an inner plate and an outer plate adapted to be superposed one upon the other with at least partial overlap to form a cover extending between the case side walls with one edge of each plate normally substantially abutting the inner face of an associated case side wall, coupling means on each said plate edge and on the associated side wall for confining said plate edge to a predetermined level on the side wall, each coupling means being engageable and releasable by virtue of respective movements of the associated plate substantially in its own plane toward and away from the associated side wall, and releasable locking means for coupling the plates together in said normal positions to lock each of them against movement away from the associated case side wall.

23. A set of flat tumblers of similar shape adapted to be mounted in a lock for relative sliding movement under key control for operation of the lock, further characterized in that each tumbler comprises sheet material and has two opposite edges, said tumblers have adjacent each of said edges a relatively narrow area in which the tumbler thickness is increased by folding of the material, and said areas of increased thickness are sufficiently wide to provide overlap with corresponding areas of adjacent tumblers in all operating positions of the tumblers in the lock.

24. A tumbler set according to claim 23 wherein said relative tumbler movement in the lock is predominantly parallel to a predetermined direction, and said opposite edges of each tumbler are generally parallel to said direction.

25. A tumbler set according to claim 24 wherein the tumbler thickness in said thickened areas is substantially independent of thickness variations of said sheet material.

26. A tumbler set according to claim 24 wherein on both faces of the tumblers, the surfaces of the thickened, areas are elevated relative to the surface between those areas.

* * * * *